US005956967A

United States Patent [19]

Kim

[11] Patent Number: 5,956,967

[45] Date of Patent: Sep. 28, 1999

[54] DISPENSER ASSEMBLY FOR REFRIGERATOR AND CONTROL METHOD THEREOF

[75] Inventor: Yong Sik Kim, Changwon, Rep. of Korea

[73] Assignee: LG Electronics Inc., Rep. of Korea

[21] Appl. No.: 08/996,632

[22] Filed: Dec. 23, 1997

[30] Foreign Application Priority Data

Sep. 23, 1997 [KR] Rep. of Korea ..... 1997 48163

[51] Int. Cl.[6] ..... F25D 23/12; B67D 5/62

[52] U.S. Cl. ..... 62/390; 62/391; 222/146.6

[58] Field of Search ..... 62/389, 390, 391, 62/394, 396; 222/146.6

[56] References Cited

U.S. PATENT DOCUMENTS

| | | | |
|---|---|---|---|
| 2,894,377 | 7/1959 | Shikles et al. | 62/390 |
| 3,969,909 | 7/1976 | Barto et al. | 62/179 |
| 5,542,265 | 8/1996 | Rutland | 62/389 |
| 5,603,230 | 2/1997 | Tsai | 62/390 |

FOREIGN PATENT DOCUMENTS

| | | | |
|---|---|---|---|
| 2671863 | 7/1992 | France | 62/389 |
| 9009952 | 2/1990 | WIPO . | |

*Primary Examiner*—William Doerrler

*Attorney, Agent, or Firm*—Ostrolenk, Faber, Gerb & Soffen, LLP

[57] ABSTRACT

A refrigerator dispenser assembly and a control method thereof by which a user can selectively drink drinks such as juice, barley-boiled water and the like including water through the dispenser. The assembly includes a water supply valve connected with a water supply apparatus installed outside a refrigerator for receiving a water filtered by a filter, a water container connected with one end of the water supply valve by a connection tube for storing a predetermined amount of water therein, a cooled drink container connected with the other end of the water supply valve for storing a predetermined amount of water therein, a first temperature detection sensor installed in an outer portion of the cooled drink container for sensing a temperature of the water filled in the cooled drink container, a second temperature detection sensor installed in an outer portion of the water container for sensing a temperature of the water filled in the water container, and a dispenser for receiving water from the water container or the cooled drink container.

6 Claims, 6 Drawing Sheets

DISPENSER ASSEMBLY FOR REFRIGERATOR AND CONTROL METHOD THEREOF

BACKGROUND OF THE INVENTION

1. Field of the Invention

The present invention relates to a dispenser assembly for a refrigerator and a control method thereof, and in particular to an improved dispenser assembly for a refrigerator and a control method thereof by which a user can always enjoy a cooled drink from a dispenser even when a user often drinks the cooled water by additionally providing a cooled drink container to a refrigerator provided with a water container and dispenser.

2. Description of the Background Art

As shown in FIG. 1, in the conventional refrigerator having a water container and dispenser, an external connection tube 8 is connected with a water supply apparatus (for example, a piped water tap connected with a water pipe) installed outside the refrigerator for supplying water into the refrigerator.

In addition, a filter 1 is connected with one end portion of the external connection tube 8 for filtering water which is supplied to the interior of the refrigerator through the external connection tube 8.

A water supply valve 2 is installed in a lower portion of the filter 1 and connected with the filter 1 by a first connection tube 7*a*.

The lower portion of the water supply valve 2 is connected with one end portion of the second connection tube 7*b*, and the other end portion of the second connection tube 7*b* is connected with one end of a water container 5 for storing water which is supplied thereinto through the filter 1.

The upper portion of the water supply valve 2 is connected with one end portion of a third connection tube 7*c*, and the other end portion of the third connection tube 7*c* is connected with an ice fabricating machine 3 installed in a portion of the refrigerator.

A storing container 4 is installed below the ice manufacturing machine 3 for storing ice therein.

In addition, the other end portion of the water container 5 is connected with one end of a fourth connection tube 7*d*, and the other end portion of the fourth connection tube 7*d* is connected with a dispenser 6 installed in a front surface of the refrigerator door for discharging water to the outside.

At this time, in a front panel 11 installed above the dispenser 6, there are provided a button for discharging ice (hereinafter called an ice button 11*a*) and a button for discharging cooled water (hereinafter called a cooled water button 11*b*).

In the drawing, reference numeral 7*g* denotes a tube through which ice is moved from the storing container 4 to the dispenser 6.

The operation of the conventional refrigerator dispenser assembly will now be explained with reference to the accompanying drawings, specifically FIG. 2.

Water, which is supplied to the filter through the interior of the external connection tube 8 connected with a water supply apparatus installed outside the refrigerator, is filtered by the filter 1.

The filtered water is transferred into the interior of the water container 5 and the ice manufacturing machine 3 through the water supply valve 2.

Namely, the water supply tube 2 is provided for supplying a predetermined amount of water into the interiors of the water container 5 and the ice manufacturing machine 3 and serves to block the water supply when water is full in the water container 5 and ice manufacturing machine 3.

The water supplied to the water container 5 is cooled by the cooled air in a refrigerating chamber, and then is discharged to the outside when a user pushes a cooled water button 11*b* installed beside the dispenser 6, and the push level 12 is pushed. Therefore, a predetermined amount of the water in the water container 5 is supplied to the dispenser 6 through the fourth connection tube 7*d*.

When a predetermined amount of water is supplied from the water container 5 to the dispenser 6, as shown in FIG. 2, the water supply tube 2 is opened, and the water is externally supplied to the water container 5 so that a predetermined amount of water is maintained in the water container 5.

In addition, after a predetermined amount of water is supplied to the ice manufacturing machine 3, when ice manufacturing step is finished, the thusly produced ice is stored in the storing container 4. Thereafter, the water supply valve 2 is opened, and a predetermined amount of water is maintained in the ice manufacturing machine 3.

However, in the conventional refrigerator dispenser assembly, when a user often discharges water, since a lot of cooled water is discharged to the outside, it is impossible to quickly cool the water in the water container during a short time, so that a user may drink water which is not fully cooled due to the increased use of the water.

SUMMARY OF THE INVENTION

Accordingly, it is an object of the present invention to provide a dispenser assembly for a refrigerator and a control method thereof which overcome the aforementioned problems encountered in the background art.

It is another object of the present invention to provide a dispenser assembly for a refrigerator and a control method thereof by which a user can always enjoy a cooled drink from a dispenser even when a user often drinks the cooled water by additionally providing a cooled drink container to a refrigerator provided with a water container and dispenser.

It is another object of the present invention to provide a refrigerator dispenser assembly and a control method thereof by which a user can selectively drink drinks such as juice, barley-boiled water and the like including water through the dispenser.

To achieve the above objects, there is provided a dispenser assembly for a refrigerator which includes a water supply valve connected with a water supply apparatus installed outside a refrigerator for receiving a water filtered by a filter, a water container connected with one end of the water supply valve by a connection tube for storing a predetermined amount of water therein, a cooled drink container connected with the other end of the water supply valve for storing a predetermined amount of water therein, a first temperature detection sensor installed in an outer portion of the cooled drink container for sensing a temperature of the water filled in the cooled drink container, a second temperature detection sensor installed in an outer portion of the water container for sensing a temperature of the water filled in the water container, and a dispenser for receiving water from the water container or the cooled drink container.

To achieve the above objects, there is provided a dispenser assembly control method for a refrigerator according to an embodiment of the present invention which includes the steps of pushing a cooled water button of a front surface panel installed in an upper portion of a dispenser, transferring a signal to a control apparatus wherein a first temperature sensor and a second temperature detection sensor detects temperatures of water in a cooled drink container and a water container, supplying water from the water container to a dispenser when a temperature of water in the water container is lower than a temperature of water in the cooled drink container, supplying water (drink) from the cooled drink container to the dispenser when a temperature of water in the water container is higher than a temperature of water in the cooled drink container, and discharging water having a lower temperature between the temperatures detected by the first temperature detection sensor and second temperature detection sensor.

To achieve the above objects, there is provided a dispenser assembly control method for a refrigerator according to an embodiment of the present invention which includes the steps of driving a check valve by pushing a drink selection button of a front surface panel installed in an upper portion of a dispenser, opening a water supply cover of a cooled drink container and filling a selection drink thereinto, and discharging the selection drink from the cooled drink container by pushing a push lever.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The dispenser assembly for a refrigerator and a control method thereof according to the present invention will now be explained with reference to the accompanying drawings.

Figure 1:
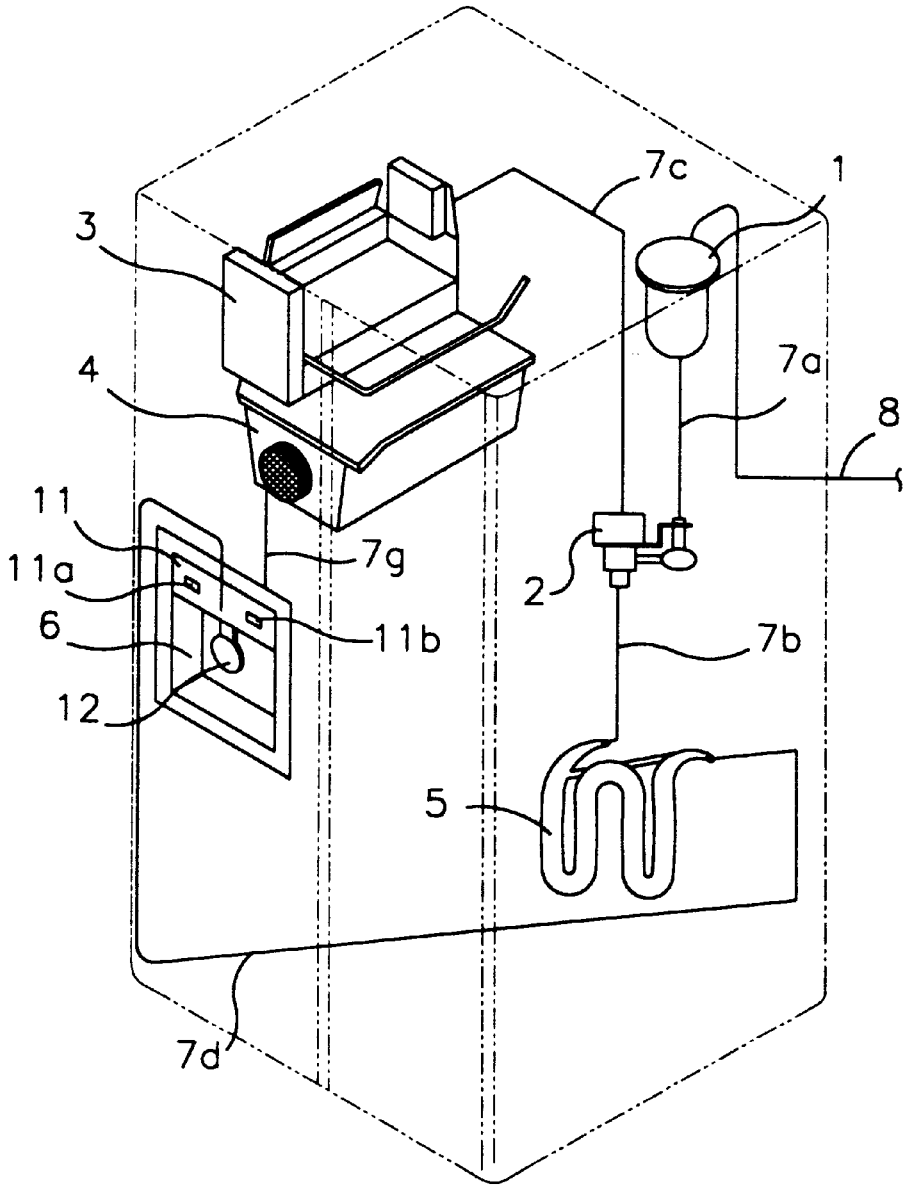
FIG. 1 CONVENTIONAL ART
FIG. 1 is a schematic perspective view illustrating a conventional refrigerator dispenser assembly.
Figure 2:
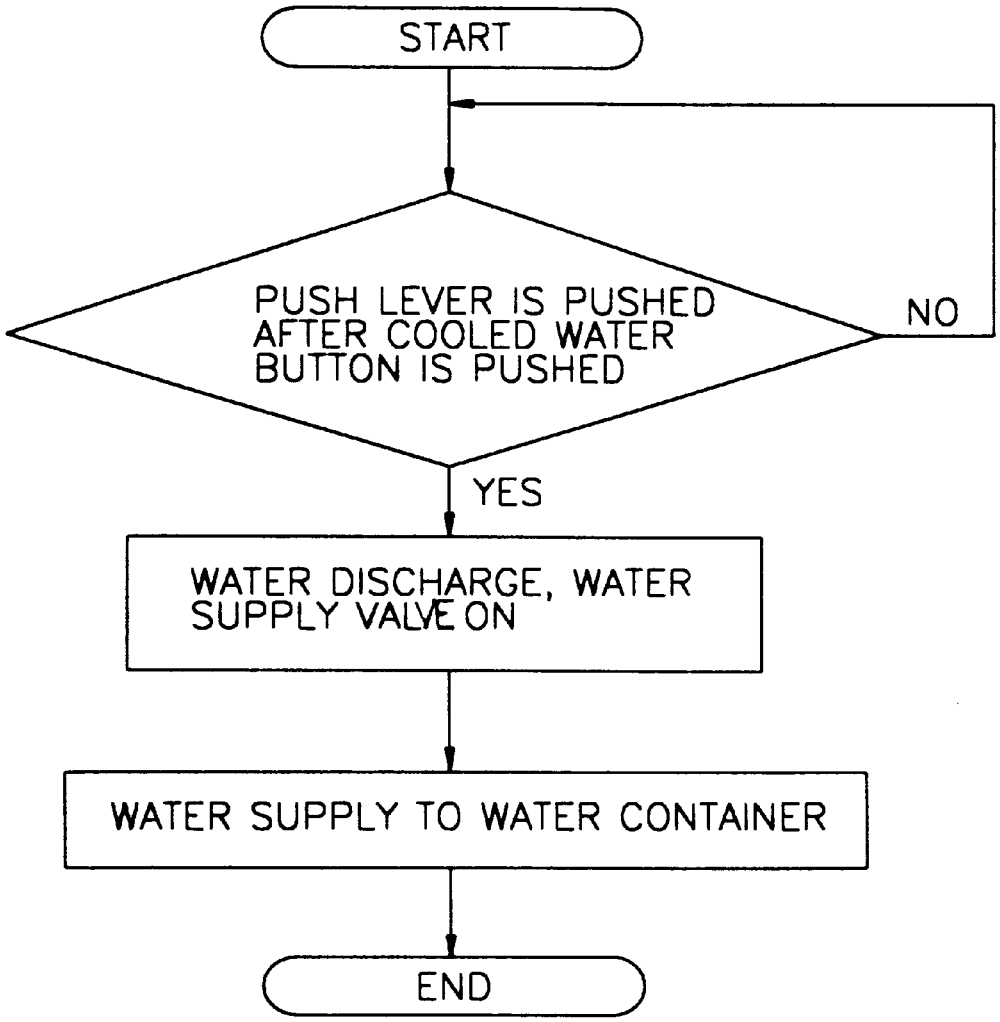
FIG. 2 CONVENTIONAL ART
FIG. 2 is a flow chart illustrating an operation of a conventional refrigerator dispenser assembly.
Figure 3:
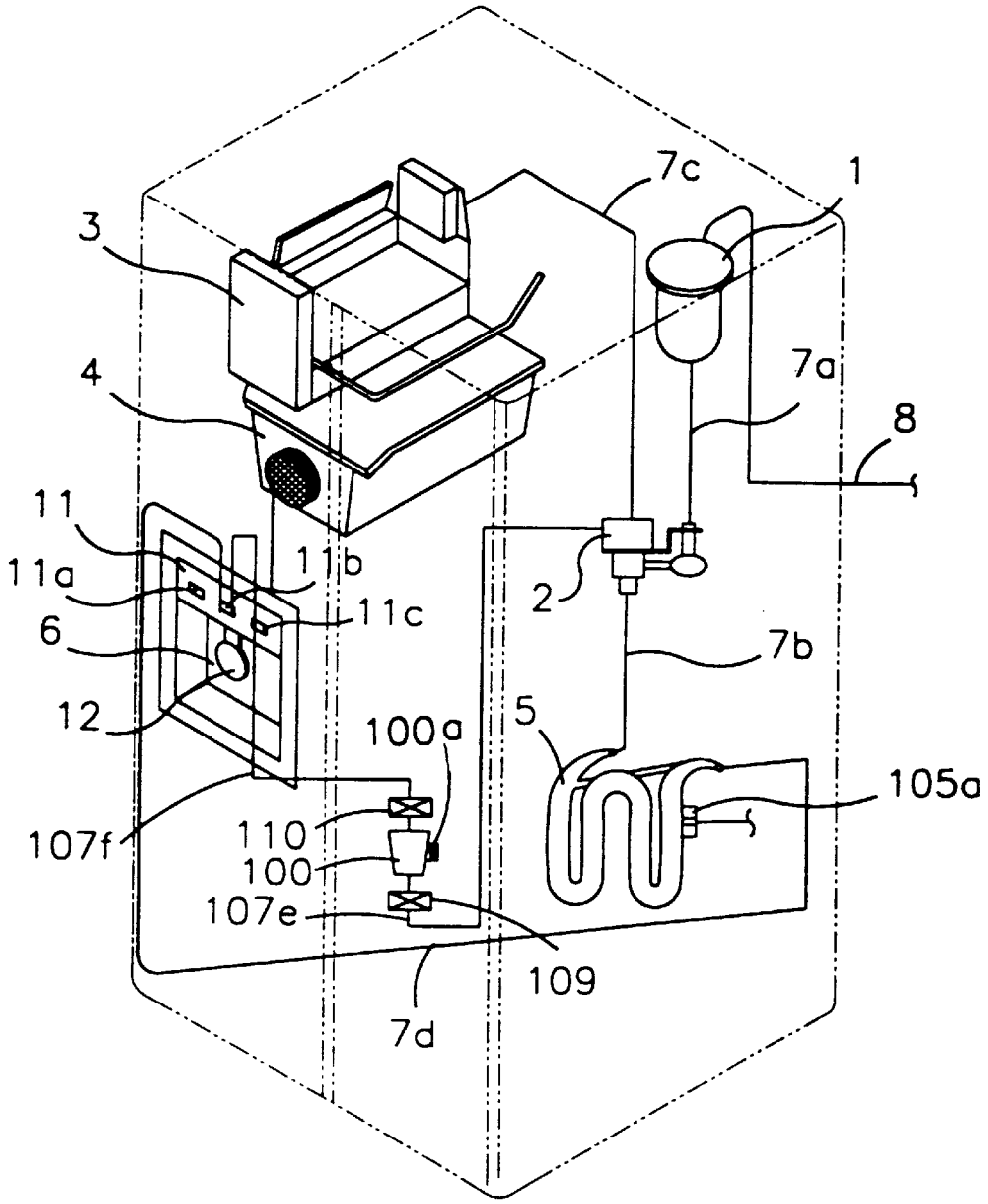
FIG. 3 is a schematic perspective view illustrating a refrigerator dispenser assembly according to the present invention.

As shown in FIG. 3, differently from the conventional refrigerator dispenser assembly, in the present invention, there is further provided a cooled drink container 100 between the water supply valve and dispenser. Parts and assemblies which are similar to the conventional art are assigned identical reference numerals and their repeated detailed description will be omitted.

In the refrigerator dispenser assembly according to the present invention, the supply valve 2 is connected with the second connection tube 7*b* and the third connection tube 7*c* and is further connected with one end portion of a fifth connection tube 107*e*, thus forming a three-way connection configuration. The other end portion of the fifth connection tube 107*e* is connected with a lower portion of the cooled drink container 100.

At this time, a first temperature detection sensor 100*a* (for example, thermostat) is installed in an outer portion of the cooled drink container 100 for measuring the temperature of water or drink in the cooled drink container 100 and transferring a signal to a control apparatus (not shown), and a check valve 109 is installed in a predetermined portion of the fifth connection tube 107*e* installed below the cooled drink container 100.

Figure 4:
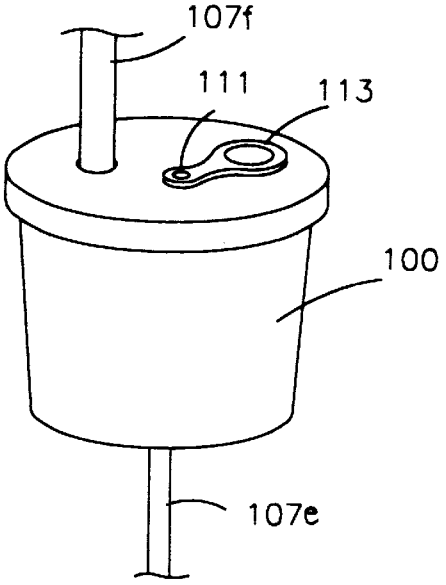
FIG. 4 is a perspective view illustrating a cooled drink container of a refrigerator dispenser assembly according to the present invention.

In addition, the upper portion of the cooled drink container 100, as shown in FIG. 4, is connected with one end portion of a sixth connection tube 107*f*, and the other end portion of the sixth connection tube 107*f* is connected with the dispenser 6.

At this time, a pump 110 is installed in a predetermined portion of the sixth connection tube 107*f* installed above the cooled drink container 100.

The construction of the cooled drink container 100 will be described in more detail.

As shown in FIG. 4, a predetermined shaped selection drink supply hole 114, through which a selection drink such as a juice, tea, barley-boiled water, etc. is supplied, is formed on the upper surface of the cooled drink container 100.

In addition, a hole cover 113 is detachable disposed on the upper surface of the selection drink supply hole 114 for preventing water or drinks from being over-flown.

The engaging structure of the cooled drink container 100 having the selection drink supply hole 114 and the hole cover 113 will now be explained in more detail.

Figure 5A:
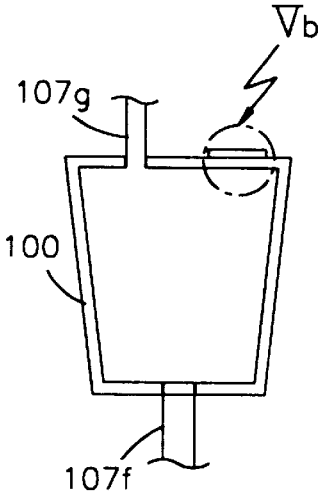
FIG. 5A is a cross-sectional view illustrating a cooled drink container for a refrigerator dispenser assembly according to the present invention.
Figure 5B:
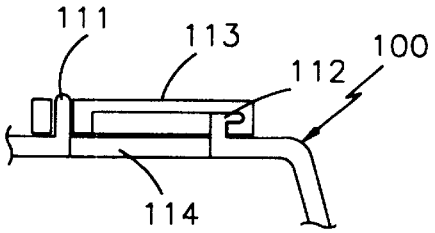
FIG. 5B is a detailed view illustrating the portion Vb of FIG. 5A.
Figure 6A:
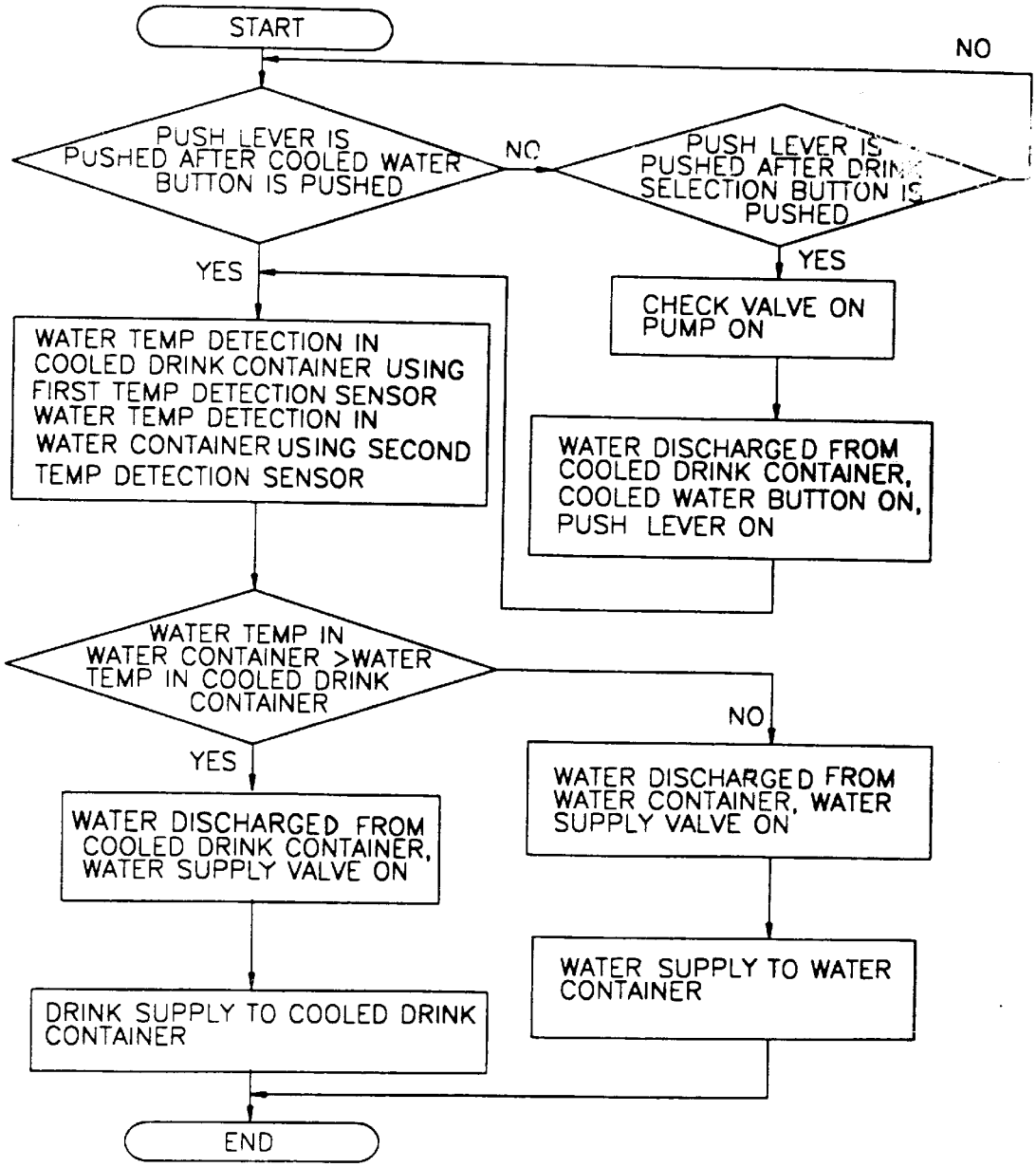
FIG. 6A is a flow chart illustrating an operation of a refrigerator dispenser assembly according to the present invention when water is filled in a cooled drink container.
Figure 6B:
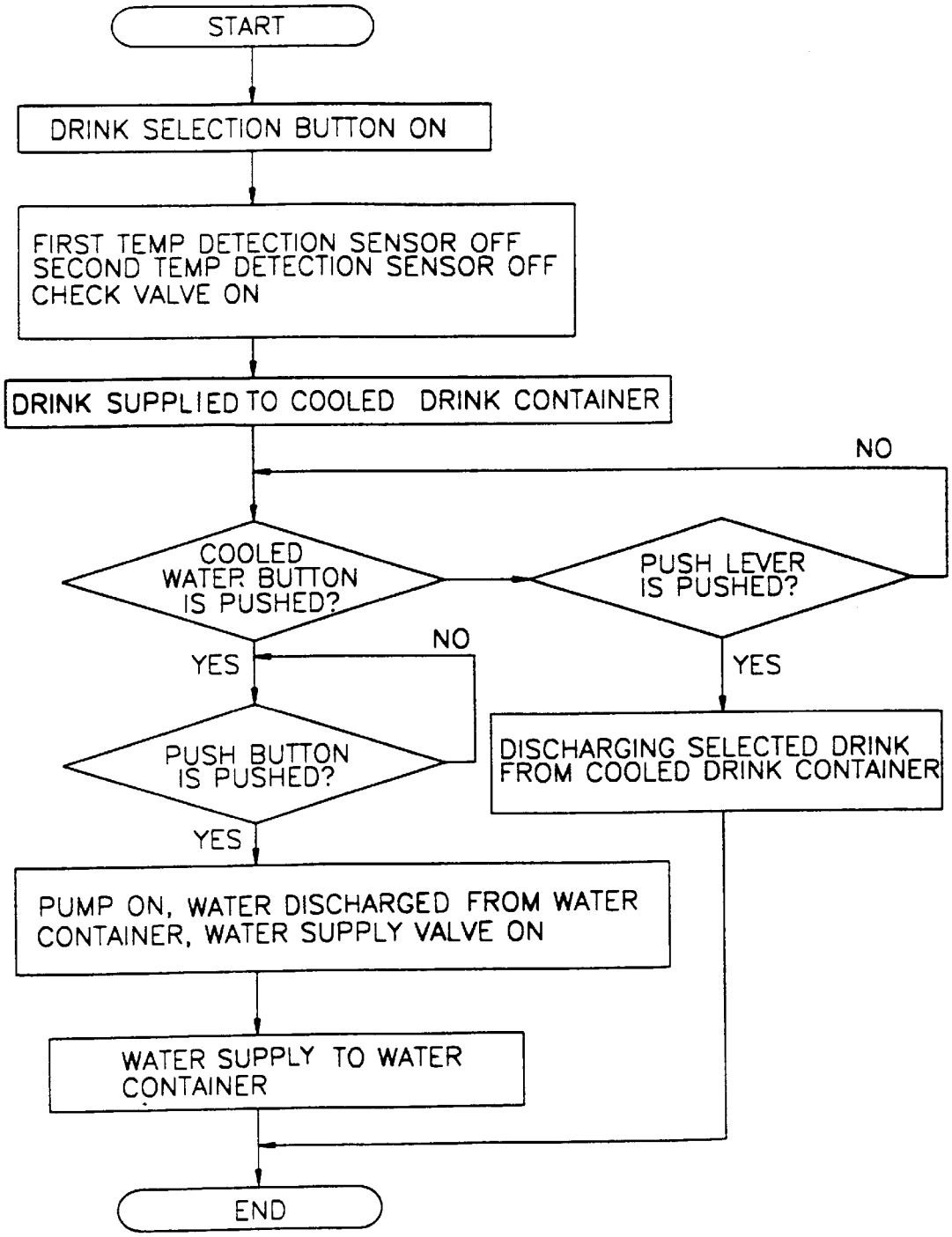
FIG. 6B is a flow chart illustrating an operation of a refrigerator dispenser assembly according to the present invention when a selection drink is filled in a cooled drink container.

As shown in FIGS. 5A and 5B, a protrusion 111 is formed on the upper surface of the cooled drink container 100, on which one end portion of the selection drink supply hole 114 is formed.

In addition, a 90°-curved engaging portion 112 is formed on the upper surface of the cooled drink container 100 in which the other end portion of the selection drink supply hole 114 opposing with one end portion of the selection drink supply hole 114 is formed.

One end portion of the supply hole cover 113 is rotatably fixed to the protrusion 111, and the other end portion thereof is forcibly inserted into the curved surfaces of the engaging portion 112 thus fully covering the selection drink supply hole 114.

Returning to FIG. 3, a second temperature detection sensor 105*a* (for example, thermostat) is installed in a predetermined outer portion of the water container 5 for measuring the temperature of the water in the water container 5 and transferring a signal to the control apparatus.

A front panel 11 on which an ice button 11*a*, a cooled water button 11*b*, and a drink selection button 11*c* are formed is installed above the dispenser 6, so that a user can select one of the various kinds of drinks.

The operation of the refrigerator dispenser assembly according to the present invention will now be explained with reference to the accompanying drawings.

The water (drink) supplied into the interior of the refrigerator through the external connection tube 8 installed in the water supply apparatus installed outside the refrigerator is filtered by the filter 1, and the thusly filtered water is supplied to the ice manufacturing machine 3, the water container 5, and the cooled drink container, respectively, through the supply valve 2 in accordance with an instruction from the control apparatus.

At this time, when a user pushed the cooled water button 11*b* installed in the front surface panel of the dispenser 6 and pushes the push lever 12, the first temperature detection sensor 100*a* and the second temperature detection sensor 105*a* detect the temperatures of the water (drinks) filled in the water container 5 and the cooled drink container 100. Among the water and drinks stored therein, a cooler water (drink) is supplied to the dispenser 6, so that a user can drink a cooled water (drink).

At this time, the pump 110 and check valve 109 do not operate.

When a user wishes to fill a predetermined drink other than water into the cooled drink container 100, the user pushes the drink selection button 11*c*, and opens the hole cover 113 of the cooled drink container 100, and a selected drink is filled into the interior of the cooled drink container 100.

Thereafter, when the push lever 12 is pushed by a cup or the like by a user, so that the selected drink is discharged to the outside.

When the drink selection button 11*c* is pushed, the check valve 109 installed in a lower portion of the cooled drink container 100 is turned on, and the water in the fifth connection tube 107*e* is blocked from being supplied to the interior of the cooled drink container 100, so that the selected drink is discharged to the outside from the cooled drink container 100 by the force generated by the pump 110.

In addition, when a selected drink is filled in the cooled drink container 100, and a user pushes a corresponding cooled water button, the driving operation of the pump 110 is stopped.

The operation of the refrigerator dispenser assembly according to the present invention will be explained in more detail by dividing the operation into two cases, namely, water is filled in the cooled drink (water) container 100 and a selection drink is filled in the cooled drink container 100.

First, when water is filled in the cooled drink container 100, and a user pushes the cooled water button 11*b* and pushes the push lever 12, the first temperature selection detection sensor 100*a* and second temperature detection sensor 105*a* detect the temperatures of the water in the cooled drink container 100 and water container 5 and transfers a predetermined signal to the control apparatus (not shown).

At this time, if the temperature of the water in the water container 5 is lower than the temperature of the water (drink) in the cooled drink container 100, the water in the water container 5 is supplied to the dispenser 6 through the fourth connection tube 7*b*, so that a user enjoys a cooled water.

On the contrary, if the temperature of the water in the water container 5 is higher than the temperature of the water (drink) in the cooled drink container 100, the water (drink) in the cooled drink container 100 is supplied to the dispenser 6 through the sixth connection tube 107*f*, so that a user enjoys a cooled water.

In addition, when a user pushes the drink selection button 11*c*, and then pushes the push lever 12, the check valve 109 installed below the cooled drink container 100 is turned on, so that the water in the fifth connection tube 107*e* is prevented from being transferred into the interior of the cooled drink container 100. Therefore, the water (drink) in the cooled drink container 100 is discharged by the pump 110. In this case, the water (drink) is not supplied to the cooled drink container 100.

In this case, since a user does not get a desired drink, the selection using the drink selection button 11*c* is cancelled. At this time, the cooled water button 11*b* is pushed, so that the first temperature detection sensor 100*a* and second temperature detection sensor 105*a* and the check valve 109 are driven, and thus cooler water is discharged from the water container 5 and cooled drink container 100.

Even when water is filled in the cooled drink container 100, and a user pushes the drink selection button 11*c*, it is possible to drink a substantially cooled water.

On the contrary, if the selection drink is filled in the cooled drink container 100, the drink selection button 11*c* is enable, and the first temperature detection sensor 100*a* and the second temperature detection sensor 105*a* are not driven, and the check valve 109 is driven.

At this time, after a user pushes the cooled water button 11*b* and pushes the push lever 12, the water in the water container 5 is discharged.

In addition, when the user pushes the drink selection button 11*c* and pushes the push lever 12, the pump 110 is driven, and the selection drink in the interior of the cooled drink container 100 is discharged.

As described above, in the dispenser assembly for a refrigerator and a control method thereof according to the present invention, it is possible to always produce a cooled water (drink) by providing a cooled drink container additionally to the water container, so that the reliability of the product is increased.

In addition, a cooled water as well as a cooled drink may be selectively used using only dispenser.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A dispenser assembly for a refrigerator, comprising:

a water supply valve connected with a water supply apparatus installed outside a refrigerator for receiving water filtered by a filter;

a water container connected with one end of the water supply valve by a connection tube for storing a predetermined amount of water therein;

a cooled drink container connected with the other end of the water supply valve for storing a first predetermined amount of water therein;

a first temperature detection sensor installed in an outer portion of the cooled drink container for sensing a temperature of the water filled in the cooled drink container;

a second temperature detection sensor installed in an outer portion of the water container for sensing a temperature of the water filled in the water container; and a dispenser for receiving water from the water container or the cooled drink container.

2. The assembly of claim 1, wherein said dispenser receives the water which has a lower temperature of water in the containers in which the temperatures of water in the containers are sensed by the first temperature sensor and the second temperature detection sensor, respectively.

3. The assembly of claim 1, further comprising a front surface panel installed in an upper portion of the dispenser and having a cooled water button and a drink selection button, a check valve installed in a predetermined portion of the connection tube connected with the cooled drink container and driven by the drink selection button, and a pump installed in a predetermined portion of the connection tube connected with the other end portion of the cooled drink container and driven by the drink selection button.

4. The assembly of claim 1, further comprising a supply hole formed on an upper surface of the cooled drink container and a supply hole cover detachable engaged on an upper surface for covering the supply hole.

5. The assembly of claim 4, further comprising a protrusion formed on an upper surface of the cooled drink container for detachably engaging the supply hole cover, and an engaging portion which is covered at a predetermined angle.

6. A dispenser assembly control method for a refrigerator, comprising the steps of:

pushing a cooled water button of a front surface panel installed in an upper portion of a refrigerator;

transferring a signal to a control apparatus wherein a first temperature detection sensor and a second temperature detection sensor detects temperatures of water in a cooled drink container and a water container;

supplying water from the water container to the dispenser when a temperature of water in the water container is lower than a temperature of water in the cooled drink container;

supplying water from the cooled drink container to the dispenser when a temperature of water in the water container is higher than a temperature of water in the cooled drink container; and discharging water from the container having the lower temperature detected by the first temperature detection sensor and second temperature detection sensor.

* * * * *